United States Patent [19]

Blackburn et al.

[11] 4,248,815

[45] Feb. 3, 1981

[54] PROCESS FOR THE MANUFACTURE OF GATE VALVES FOR CLOSURE DEVICES HAVING A POURING NOZZLE AND SIMILAR OBJECTS

[75] Inventors: James B. Blackburn, Sete; Jean L. Randon, Cournonterral, both of France

[73] Assignee: Kaiser Electro Refractaire France, Paris, France

[21] Appl. No.: 9,807

[22] Filed: Feb. 6, 1979

Related U.S. Application Data

[63] Continuation-in-part of Ser. No. 942,707, Sep. 15, 1978, abandoned.

[30] Foreign Application Priority Data

Mar. 13, 1978 [FR] France ..... 78 07190

[51] Int. Cl.[3] ..... B28B 1/08; B28B 3/08

[52] U.S. Cl. ..... 264/71; 222/600; 251/155; 251/176; 251/193; 264/72; 264/268; 264/333

[58] Field of Search ..... 264/71, 72, 69, 333, 264/60, 268; 222/600; 251/155, 176, 193

[56] References Cited

U.S. PATENT DOCUMENTS

| | | | |
|---|---|---|---|
| 2,311,358 | 2/1943 | Baily | 264/71 |
| 3,192,292 | 6/1965 | Banks | 264/71 |
| 3,639,552 | 2/1972 | Michal | 264/71 |
| 3,926,406 | 12/1975 | Hind | 251/144 |
| 3,963,815 | 6/1976 | Ezaki et al. | 264/71 |
| 3,970,283 | 7/1976 | Hind | 251/144 |
| 3,995,086 | 11/1976 | Plunguian | 264/338 |
| 4,039,703 | 8/1977 | Kamijo et al. | 264/69 |
| 4,063,668 | 12/1977 | Shepland | 222/512 |
| 4,175,974 | 11/1979 | Grabner et al. | 222/600 |
| 4,179,046 | 12/1979 | Jeschke et al. | 222/600 |
| 4,182,466 | 1/1980 | Fehling et al. | 222/600 |

FOREIGN PATENT DOCUMENTS

| | | | |
|---|---|---|---|
| 2624299 | 12/1976 | Fed. Rep. of Germany . | |
| 2355596 | 6/1977 | France | 264/71 |
| 7719344 | 6/1977 | France | 264/71 |
| 126900 | 5/1919 | United Kingdom . | |
| 394668 | 6/1933 | United Kingdom . | |
| 675666 | 7/1952 | United Kingdom . | |
| 1117018 | 6/1968 | United Kingdom . | |
| 1199070 | 7/1970 | United Kingdom . | |

*Primary Examiner*—Donald J. Arnold

*Attorney, Agent, or Firm*—Burns, Doane, Swecker & Mathis

[57] ABSTRACT

In order to manufacture a casting nozzle plate assembly, e.g., a sliding closure of a slide plate and collector nozzle, without having to further machine the working surface of one assembly a mold is arranged on a trued slab. A refractory concrete is poured into the mold while the mold is vibrated. The concrete is allowed to harden before being separated from trued slab. The resulting assembly has a smooth work (e.g., sliding) surface for contact with another element.

11 Claims, 3 Drawing Figures

1
2
3
4
5
6
7
8
9
3a
3b
3c
F1
10
10a
11
12
12a
13
14
15
16
17

PROCESS FOR THE MANUFACTURE OF GATE VALVES FOR CLOSURE DEVICES HAVING A POURING NOZZLE AND SIMILAR OBJECTS

REFERENCE TO RELATED APPLICATION

The present application is a continuation-in-part application of our prior U.S. Patent Application Ser. No. 942,707, filed Sept. 15, 1978, and now abandoned.

BACKGROUND OF THE PRESENT INVENTION

The present invention relates to the manufacture of gate valve assemblies of the sliding or rotary type for closure devices having a pouring nozzle, e.g., a molten metal ladle or tundish. Customarily, these assemblies are comprised of a plurality of slabs of refractory bricks pierced by a hole and designed to slide or rotate with respect to each other in order to allow steel or pig iron to flow from a casting ladle or, on the contrary, stop the flow. As understood in the art, the upper plate assembly is generally stationary while the lower plate assembly slides or rotates against the upper plate assembly. As used herein, the term "gate valve assembly" is intended to mean either the upper plate assembly or the lower plate assembly.

The manufacture of these gate valve assemblies generally requires the use of special refractory products resistant to the erosion of the flowing molten metal and to thermal shock, a precise assembly of the bricks comprising them, and machining of the sliding faces so as to avoid leakage of metal. As known in the art, these sliding or rotary gate valve assemblies are formed from a plurality of preformed pieces of refractory material which are assembled, generally with a heat settable cement. The refractory material which will contact the molten metal is formed from high temperature fired, erosion resistant refractory material although the backup refractory may be castable. See for example, U.S. Pat. Nos. 3,926,406; 3,970,283; and 4,063,668. It will be apparent that the above-mentioned method of manufacturing gate valve assemblies involves considerable amounts of hand labor and is an expensive method for producing these valves.

It has recently been suggested in published French Patent Application Nos. 77/01683 and 77/19344 that an integral slide gate and nozzle assembly can be made by casting a refractory concrete into a metal envelope and allowing the concrete to harden within the envelope. Vibrating of the envelope to compact the concrete is disclosed in the former application. Neither of these applications disclose forming the assembly in a manner which obviates the need for further machining of the upper surface of the assembly to provide a suitably flat sliding surface.

The present invention makes it possible to manufacture gate valve assemblies more economically than before, regardless of their form, by eliminating the need to machine the sliding surface and by obviating any special care in assembly of the pieces used to form the assemblies.

SUMMARY OF THE INVENTION

In accordance with the present invention, there is provided a process for the manufacture of gate valve assemblies for closure devices having a pouring nozzle comprising the steps of placing a case, envelope or mold (hereinafter called a mold) on a trued table, mounting at least one tube in said mold, pouring a concrete of the refractory concrete type in the mold so that it spreads over the top of the trued table within the mold, causing the concrete to at least partially set, and removing the part of the gate valve assembly formed from the trued table, whereby the side of the part of the gate valve assembly formed on said trued table is shaped to constitute the sliding surface of said gate valve assembly.

It has been observed that gate valve assemblies manufactured according to said invention have unexpectedly proved to be well superior to gate valve assemblies made of pressed, fired plates which are mortared into a casing. This observation is quite surprising since generally it is believed that cast refractory pieces are inferior to fired refractory pieces in use in high temperature, molten metal-contacting applications. In addition, the gate valve assemblies made according to the process of the present invention do not require further machining of the sliding surface.

Various other characteristics and advantages of the invention are also apparent from the detailed description that follows.

DESCRIPTION OF THE DRAWINGS

The present invention is further illustrated in the attached drawings in which.

DETAILED DESCRIPTION OF THE INVENTION

Figures 1, 2, 3:
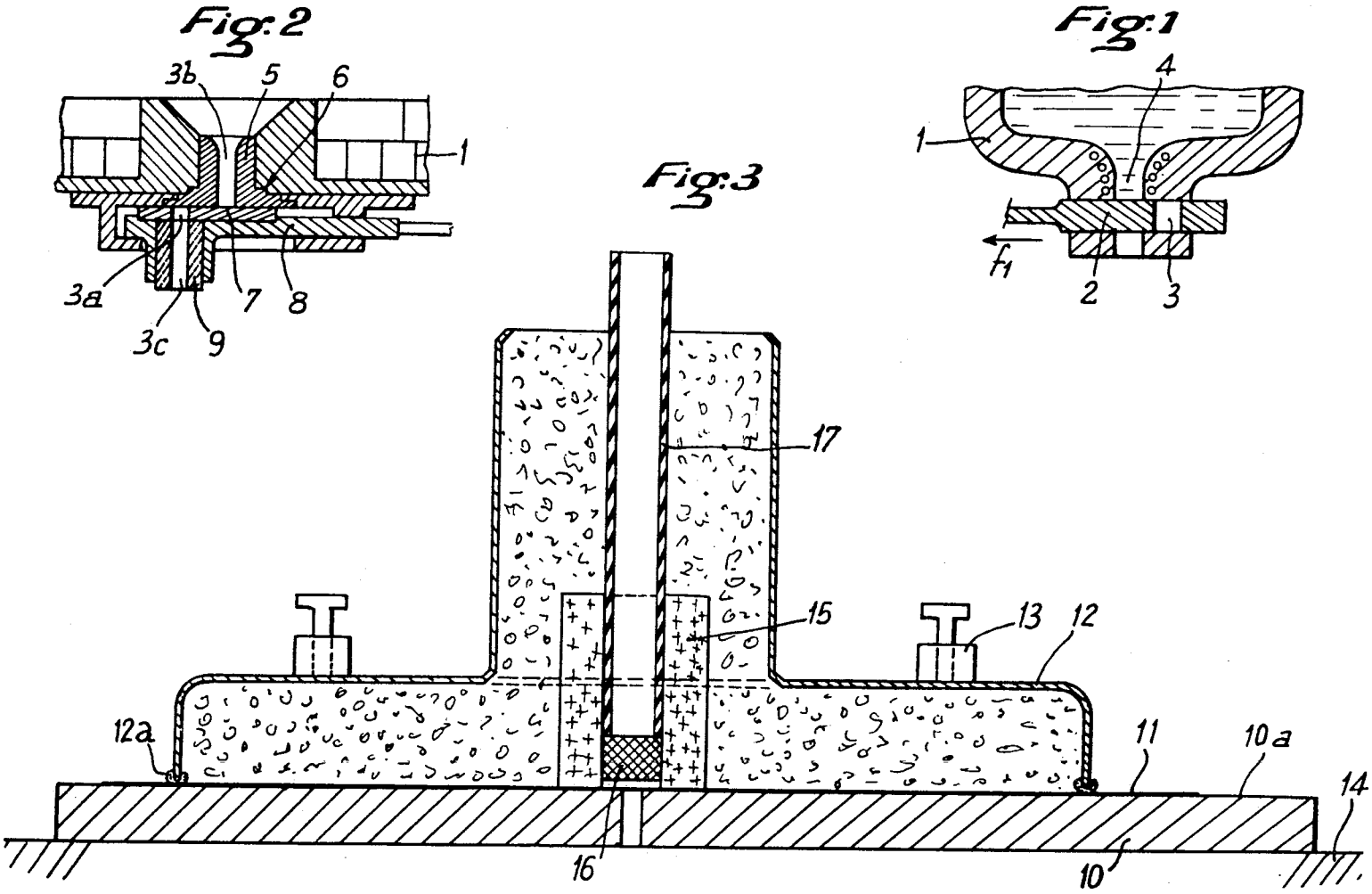
FIG. 1 is a partial vertical cross-section of a sliding closure device for a casting ladle having a valve assembly of the sliding type of the present invention.
FIG. 2 is a vertical cross-section, analogous to FIG. 1, of another embodiment of a closure having a valve assembly of the present invention.
FIG. 3 is a vertical cross-section, on a larger scale, illustrating the method of forming a sliding gate valve assembly in accordance with the present invention.

FIGS. 1 and 2 schematically illustrate a part of a sliding closure for a casting ladle or other element the bottom of which exhibits a pouring aperature through which a molten metal, notably steel, is poured. In these Figures, 1 designates the lower part of a reservoir containing a molten metal.

In FIG. 1 the closure device in the form of a slide gate valve comprises a sliding slab 2 containing an orifice 3 which can be made to coincide with an orifice 4 provided in the bottom of casting container 1 when the slab 2 is moved in the direction of the arrow $f_1$.

In FIG. 2 the device is somewhat analogous and comprises a sleeve 5 coming out of a socket (i.e., insert) 6 solidly mounted in the bottom of the casting container 1. The bottom of socket 6 is flat in order to work together with a plate or slab 7 which is arranged in a metal frame 8 in order to be capable of sliding against the bottom of socket 6. Orifices 3*a* and 3*b* are provided in plate 7 and sleeve 5 and socket 6. Orifice 3*a* of plate 7 communicates with an orifice 3*c* of a second sleeve 9.

In the two examples described above, the closure device is of the so-called slide gate valve type; that is, slab 2 (in the case of FIG. 1) or slab 7 (in the case of FIG. 2) can be displaced by sliding in order to bring orifice 3 and orifice 4 into coincidence (in FIG. 1) or orifices 3*a* and 3*b* into coincidence (in the case of FIG. 2). In other known constructions, the plates or slabs are mounted so as to be capable of turning, bringing two holes or orifices together or separating them with respect to each other.

As was explained in the foregoing, the manufacture of such closure devices requires the use of refractory products resistant to thermal shock and it requires that the surfaces which are to slide on each other (that is, to slide or to pivot) be perfectly machined in order to avoid leakage of metal.

In accordance with the invention the slide gate valve of the closure device is made in monolithic fashion without the necessity of machining.

For this, as FIG. 3 shows, a table 10 the top 10*a* of which is trued and on which, for example, a sheet or plate 11 of plastic material (for example, of tetrafluoroethylene or polyester) is spread or otherwise deposited. It is also possible for sheet 11 to be simply replaced by a hard and non-adherent coating 10*a* of the table (for example, by a layer of chrome). This layer or the upper surface of sheet or plate 11 is, if necessary, coated with a stripping compound such as wax. A mold 12 is then arranged on sheet 11, the mold being maintained tight against sheet 11 by means of brackets 13. A sealing gasket 12*a* is advantageously arranged between the edge of mold 12 and sheet 11. The sealing gasket 12*a* is preferably made of rubber or other similar material. The mold may be provided with vent holes (not shown), if desired.

In the example shown in FIG. 3, mold 12 has the form and the dimensions, for example, of plate 7 and sleeve 9 of FIG. 2.

In accordance with one embodiment of the present invention, a initial quantity of concrete is poured within the mold cavity formed between the sheet 11 of table 10 and mold 12 which (latter) is formed, for example, of sheet metal or plastic material. The table 10, mold 12 and poured concrete assembly is then subjected to vibrations, it being provided that slab 10 is mounted on a vibrating table 14.

The frequency of the vibrations depends on the nature of the concrete used and may, for example, be between 6000 and 9000 cycles per second, for an aluminous concrete. The initial quantity of concrete poured is then heated, for example to about 100° C. so that it begins to set. Then, after cooling, another quantity of concrete is poured in order to fill mold 12 completely, after which the concrete is allowed to set. Pouring the concrete in two operations makes it possible to avoid the face in contact with the sheet 11 later having a slight curvature due to the shrinkage occuring as the concrete dries. When the concrete is poured in two operations, the initial pour is in an amount sufficient to maintain the face in contact with the plate 11 in a substantially flat configuration when the concrete dries, which amount will vary but is generally in an amount of from about 10 to about 50 percent of the total concrete poured in both operations. The nature of the concretes of the successive pours can if necessary be different, so that the different parts of the piece are of a material suitable for their particular methods of operation.

According to another, preferred embodiment of the present invention, and particularly when concretes which shrink a small constant amount are used, the concrete is poured in a single operation again using vibration in the manner described above. It is also possible to form table 10 (and its coating or sheet 11) to have a slight initial concave curvature which curvature is chosen to offset the convex curvature formed by the concrete during curing so that a flat surface results.

In order to delimit the pouring channel and nozzle of slide gate valve and to reinforce the portions of the nozzle subjected to the greatest stresses, it is advantageous, as shown in FIG. 3, to arrange an insert 15 formed of a particularly resistant material 15 in mold 12. Insert 15 is held by a centering piece 16 during pouring of the concrete. Similarly, insert 15 and piece 16 are used to hold a plastic tube 17. Thus, when the concrete has finished setting, insert 15 is imprisoned, as is plastic tube 17 (this tube being intended to be destroyed during the first pour).

In the method described above, mold 12 forms part of the slide gate valve assembly made and is consequently intended to be housed in the bottom of casting container 1 or in metal frame 8 with the thickness of the metal or plastic comprising mold 12 being taken into consideration.

It is also possible according to the invention to make the slide gate in monobloc fashion without the use of mold 12. In this embodiment, mold 12 is constituted by a mold of the opening type (i.e., having at least two half-shells, not shown), the interior dimensions of said mold corresponding exactly to the dimensions of the pieces in which the valve is to be housed. In this latter process, the resulting assembly is directly housed in the support pieces of the sliding closure device. In view of the fact that the concrete is not retained on the exterior by a metal envelope, it is advantageous at the time of pouring to introduce reinforcing elements, for example, fibers or other metal reinforcing elements, into the concrete, by, for example, mixing the reinforcing elements with the concrete before it is poured.

Insert 15 described above is advantageously made of electromelted alumina, which is produced entirely compatible with aluminous concretes having a high alumina content. If necessary, the insert could be made of other materials, for instance of zirconium oxide, magnesia, silica, chromium oxide or a combination of these elements, with or without alumina.

Although it is not shown, when the slide gate valve assembly is comprised as described with reference to FIG. 1, the envelope which can be used can be made in such a way as to constitute simply the flat portion shown in FIG. 3. Likewise, the form of the slide gate valve can be more complex than shown, and in particular it is possible to form teeth on the periphery when said valve is to be of the rotating type and must be driven in rotation.

In the foregoing the word "concrete" does not necessarily imply a composition setting in the presence of water but should be understood in a broader sense and must include all suitable non-shaped refractory products capable of being joined by various means of the art.

The invention is not limited to the examples of execution shown and described in detail, because it can be modified in various ways without departing from its framework. In particular, external reinforcing of metal or of other materials can be provided at various places, particularly when no case enclosing the piece is provided. Various accessories can also be added, for example a toothed rim, support plates and other similar devices. In the embodiment of FIG. 3, providing the case 12 it is advantageous to have vent holes in said case to assist removal of air during casting.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. Process for the manufacture of gate valve assemblies for closure devices having a pouring nozzle in which the gate valve assembly has a desired sliding surface which can be utilized without grinding, comprising the steps of placing a mold on a trued table having a flatness at least that of the desired sliding surface, mounting at least one tube in said mold, pouring a concrete of the refractory concrete type in the mold so that it spreads over the top of the trued table within the mold, causing the concrete to at least partially set, vibrating said table after pouring of said concrete and before setting thereof, and removing the part of the gate valve assembly formed from said trued table, whereby the side of the part of the gate valve assembly formed on said trued table constitutes the desired sliding surface of said gate valve assembly.

2. The process of claim 1 in which said table is vibrated at a frequency between 6000 and 9000 cycles per second.

3. The process of claim 1, wherein the concrete is poured in a single operation.

4. The process of claim 1, wherein an initial quantity of concrete is first introduced into the mold, said initial quantity of concrete is caused to set to form a substantially flat surface adjacent said trued table and thereafter a second quantity of concrete is poured, so that the first quantity of concrete poured has shrunk before said second quantity of concrete is poured, whereby the surface of the nozzle formed by the trued table remains flat.

5. The process of claim 4, wherein the successively poured concretes are of different compositions.

6. The process of claim 1, wherein said mold is composed of a metal envelope held tightly on said trued table by means of brackets or clamps.

7. The process of claim 1, wherein a facing is provided on said trued table.

8. The process of claim 1, comprising the further steps of providing at least one insert of a highly resistant material in the poured concrete constituting said valve nozzle.

9. The process of claim 6, wherein said envelope forms a temporary mold and the resulting assembly is directly housed in the support pieces of said sliding closure device.

10. The process of claim 1, wherein reinforcing elements are mixed in said concrete.

11. The process of claim 1 wherein said mold is provided with a sealing gasket engaging said table.

* * * * *